US005101737A

United States Patent [19]

Gomez

[11] Patent Number: 5,101,737

[45] Date of Patent: Apr. 7, 1992

[54] PALLET ASSEMBLY

[76] Inventor: Marcos Gomez, 313 Cynisca St., Waxahachie, Tex. 75165

[21] Appl. No.: 673,314

[22] Filed: Mar. 22, 1991

[51] Int. Cl.[5] ..... B65D 19/28

[52] U.S. Cl. ..... 108/51.1; 108/57.1; 108/901

[58] Field of Search ..... 108/51.1, 57.1, 901, 108/56.1, 56.3

[56] References Cited

U.S. PATENT DOCUMENTS

| | | | |
|---|---|---|---|
| 2,836,384 | 5/1958 | Haglind | 108/57.1 |
| 2,982,507 | 5/1961 | Woodward | 108/57.1 |
| 3,602,157 | 8/1971 | Cohen | 108/57.1 |
| 3,878,796 | 4/1975 | Morrison | 108/901 X |
| 3,954,067 | 5/1976 | Miles | 108/57.1 |
| 4,485,744 | 12/1984 | Umemura et al. | 108/51.1 |
| 4,869,179 | 9/1989 | Sammons | 108/51.1 X |

*Primary Examiner*—Peter A. Aschenbrenner
*Attorney, Agent, or Firm*—Leon Gilden

[57] ABSTRACT

A pallet includes a plurality of foundation rails, each of the foundation rails including planar top and bottom walls, with orthogonally oriented grooves arranged parallel to and extending coextensively of each of the rails, wherein each of the grooves define groove pairs, wherein the groove pairs receive confronting leg pairs of associated strips orthogonally secured to the foundation rails. The pallet is selectively securable together to form the pallet structure by snap-fit inter-relationship.

2 Claims, 5 Drawing Sheets

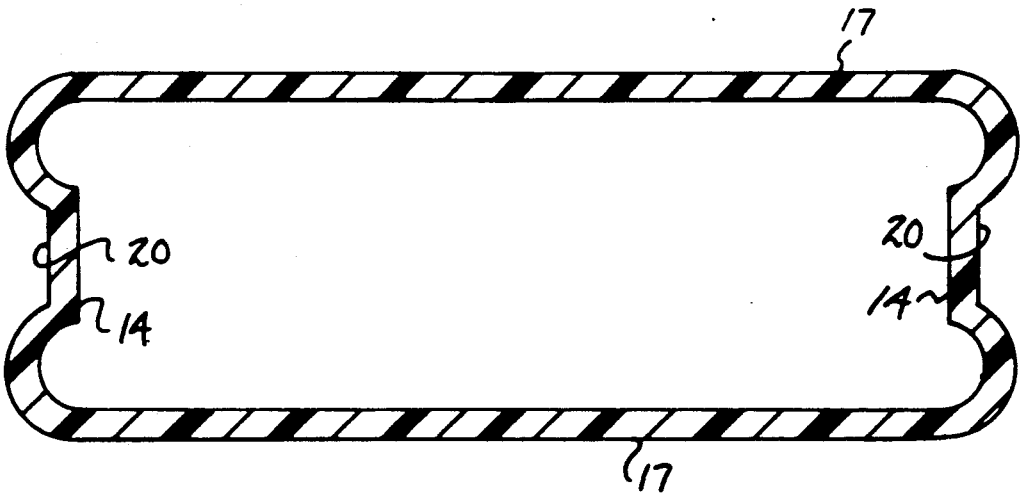
FIG 2
FIG 3
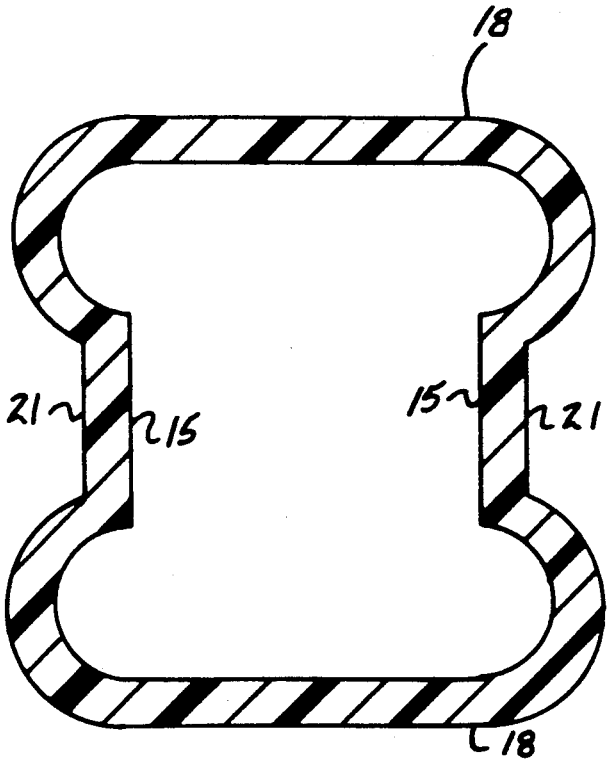

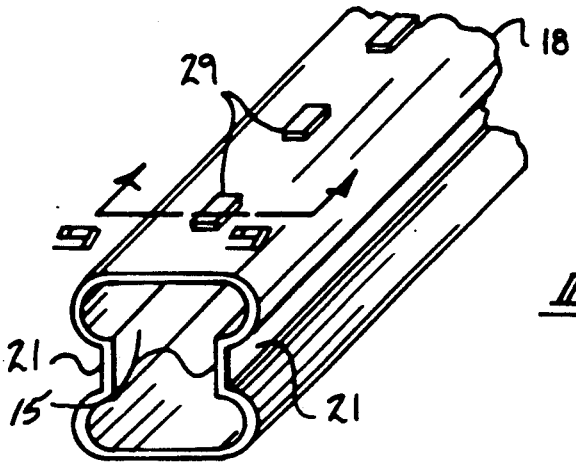
Fig 8
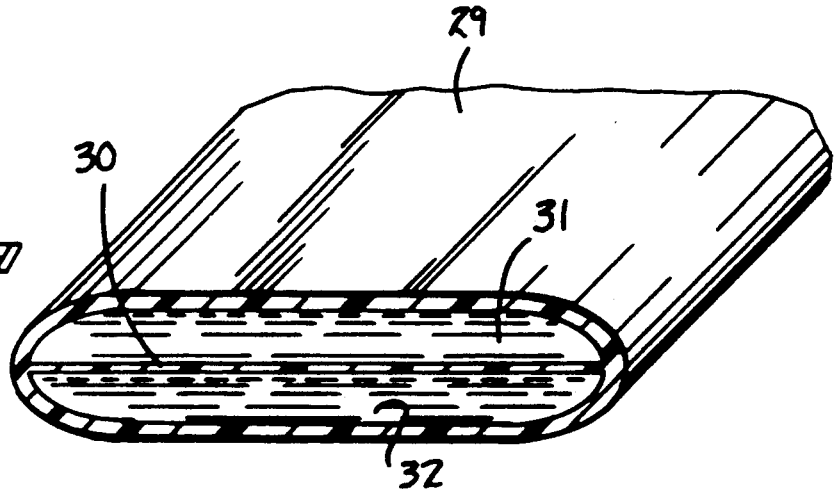
Fig 9
Fig 10
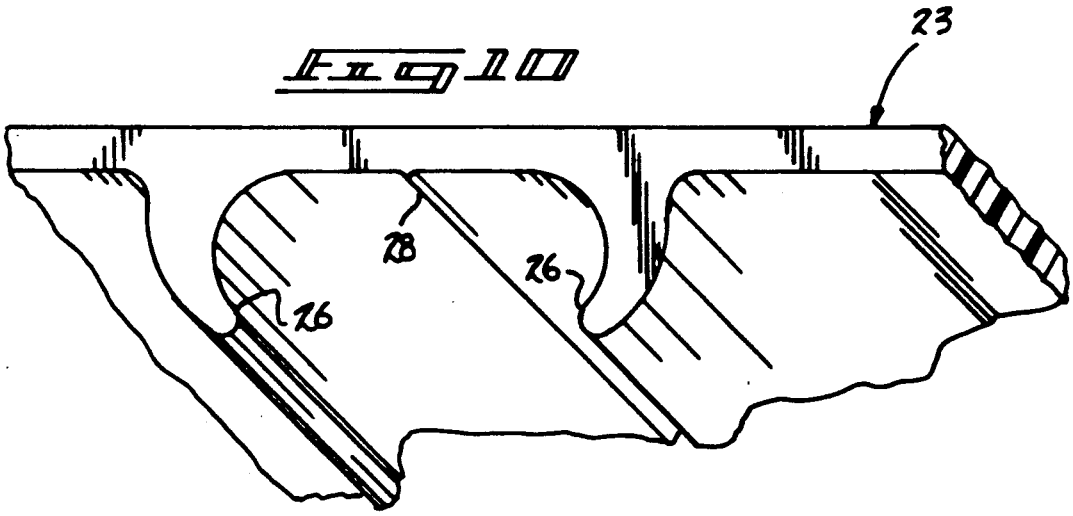

PALLET ASSEMBLY

BACKGROUND OF THE INVENTION

1. FIELD OF THE INVENTION

The field of invention relates to pallet construction, and more particularly pertains to a new and improved pallet organization wherein the same is readily assembled together for use in pallet organizations for typical use and support of various articles thereon.

2. DESCRIPTION OF THE PRIOR ART

Pallet structures are utilized for supporting various work loads and for ease of pick up by fork lift truck and the like for transportation and transport relative to various locations in warehouse and to transport vehicle. Such apparatus is exemplified in U. S. Pat. No. 4,809,618 to Bell illustrating the use of a unitary plastic pallet member.

U.S. Pat. No. 4,782,763 to Salloum sets forth a further example of a unitary pallet member for selective use.

U.S. Pat. No. 4,397,246 to Ishida, et al. sets forth a further example of a unitary pallet formed of synthetic resin.

U.S. Pat. No. 4,843,976 to Pigott sets forth a pallet member wherein central columns are snap-fit together to secure upper and lower plates together.

As such, it may be appreciated that there continues to be a need for a new and improved pallet organization as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of pallet structures now present in the prior art, the present invention provides a pallet organization wherein the same utilizes strip members mounted to elongate foundation supports for assemblage of the pallet for subsequent use. As such, the general purpose of the present invention, which will be described subsequently in greater detail, is to provide a new and improved pallet organization which has all the advantages of the prior art pallet organization and none of the disdvantages.

To attain this, the present invention provides a pallet including a plurality of foundation rails, each of the foundation rails including planar top and bottom walls, with orthogonally oriented grooves arranged parallel to and extending coextensively of each of the rails, wherein each of the grooves define groove pairs, wherein the groove pairs receive confronting leg pairs of associated strips orthogonally secured to the foundation rails. The pallet is selectively securable together to form the pallet structure by snap-fit inter-relationship.

My invention resides not in any one of these features per se, but rather in the particular combination of all them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course additional features of the invention that will be described hereinafter and which will form the subject matter of the claims appended hereto. Those skilled in the art will appreciate that the conception, upon which this disclosure is based, may readily be utilized as a basis for the designing of the other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provided a new and improved pallet organization which has all the advantages of the prior art pallet organizations and none of the disadvantages.

It is another object of the present invention to provided a new and imporoved pallet organization which may be easily and efficiently manufactured and marketed.

It is a further object of the present invention to provide a new and improved pallet organization which is of a durable and reliable construction.

An even further object of the present invention is to provided a new and improved pallet organization which is susceptible of a low cost of manufacture with regard to both materials and labor, and which accordingly is then susceptible of low price of sale to the consuming public, thereby making such pallet organizations economically available to the buying public.

Still yet another object of the present invention is to provide a new and improved pallet organization which provides in the apparatuses and methods of the prior art some of the advantages thereof, while simultaneously overcoming some of the disadvantages normally associated therewith.

Still another object of the present invention is to provide a new and improved pallet organization wherein the same is readily assembled for use and may further include adhesive packets for effecting permanent assemblage of the organization for subsequent use.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic cross-sectional illustration of exterior foundation rails utilized by the instant invention.

FIG. 3 is an orthographic cross-sectional illustration of a medial foundation rail utilized by the instant invention.

FIG. 6 is an enlarged view of the mounting rail utilized by the instant invention.

FIG. 8 is an isomtric illustration of a modified foundation rail utilized by the instant invention.

FIG. 9 is an isometric illustration, partially in section, of a gel pack utilized by the instant invention.

FIG. 10 is an isometric illustration of a modified mounting strip utilized by the intsant invention.

DESCRIPTION OF THE PREFERRED EMBODIMENT

Figure 1:
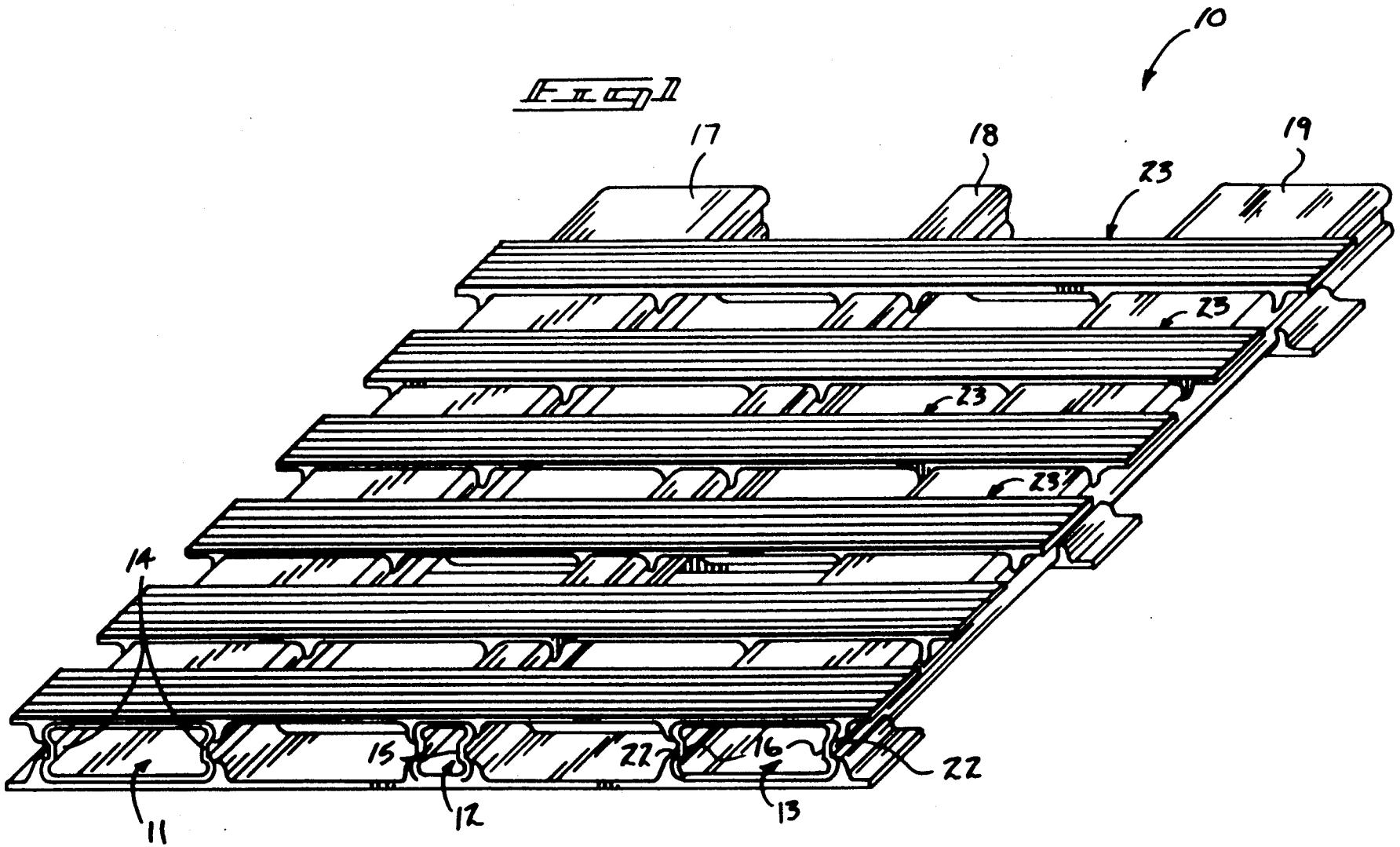
FIG. 1 is an isometric illustration of the instant invention.
Figure 4:
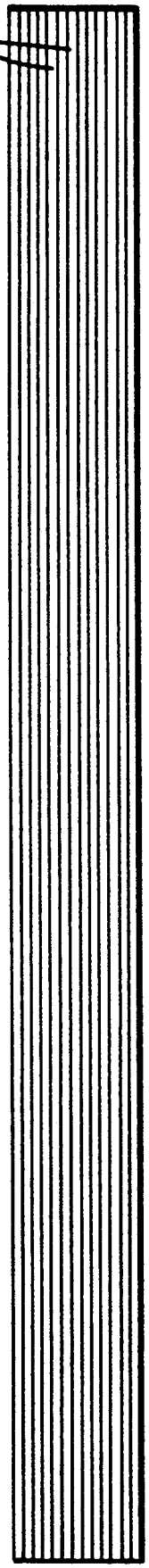
FIG. 4 is an orthographic top view of a mounting rail utilized by the instant invention.
Figure 5:
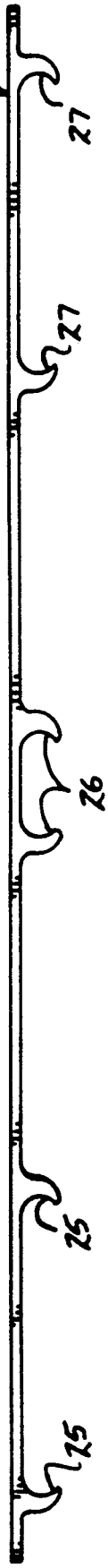
FIG. 5 is an orthographic side view, taken in elevation, of a mounting rail utilized by the instant invention.
Figure 5:
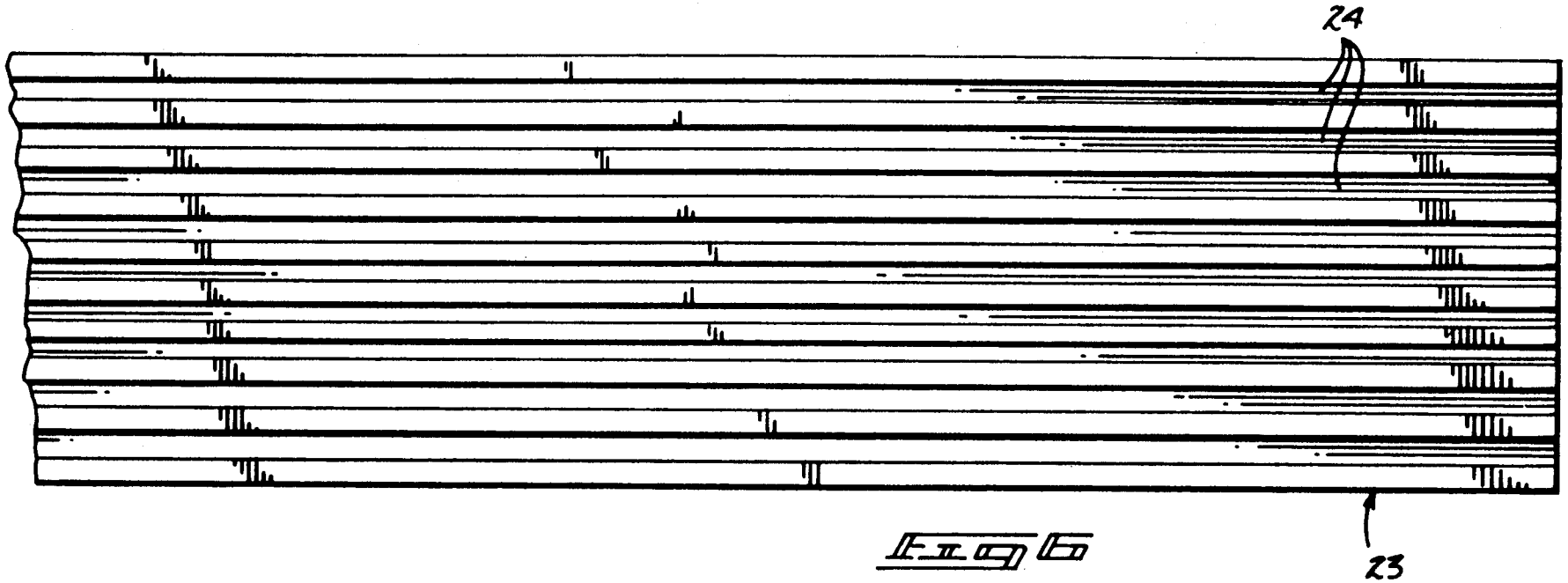
Figure 7:
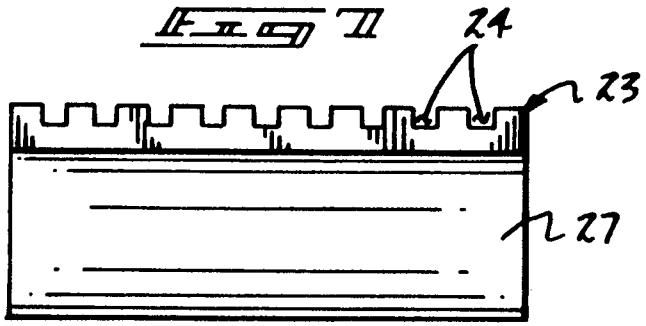
FIG. 7 is an orthographic end view of the mounting rail utilized by the instant invention.

With reference now to the drawings, and in particular to FIGS. 1 to 10 thereof, a new and improved pallet organization embodying the principles and concepts of the present invention and generally designated by the reference numeral 10 will be decribed.

More specifically, the pallet organization 10 of the instant invention essentially comprises a plurality of elongate longitudinally aligned foundation rails 11 that are arranged in a parallel relationship, defined by a respective first, second, and third foundation rail 11, 12, and 13. Each foundation rail is defined by a respective first, second, and third rail side walls 14, 15, and 16 respectively, wherein the rail side walls are arranged parallel relative to one another, wherein the respective first, second, and third rail side walls 14, 15 and 16 receive concave respective first, second, and third side wall grooves 20, 21 and 22 that are coextensively arranged and aligned relative to one another in a parallel relationship. Respective first, second, and third rails 11, 12, and 13 includes respective first planar top and bottom walls 17, second planar top and bottom walls 18, and third planar and parallel top and bottom walls 19.

Mounting strips 23 are provided. The mounting strips 23 include top strip surfaces that includes parallel strip grooves 24 for permitting directing fluid exteriorly thereof that may be deposited upon the top surfaces, where a plurality of such mounting strips 23 are mounted to the respective top and bottom walls of each of the foundation rails. The mounting strips 23 are arranged orthogonally relative to the foundation rails at predetermined spacings to the top and bottom wall. A first plurality of the mounting strips 23 are mounted to the top walls, with a second plurality of mounting strips mounted to the bottom walls. It should be noted that the mounting strips are spaced apart at equal spacing relative to the top and bottom walls to provide a rigid pallet when assembled, as illustrated in FIG. 1.

The mounting strips 23 includes plural pairs of confronting leg pairs defined by a respective first, second, and third leg pairs 25, 26, and 27, wherein each of the leg pairs are arcuately directed towards one another in confronting relationship, wherein the first confronting leg pairs 25 are received within the first side wall grooves, the second confronting leg pairs 26 are received within the second side wall grooves, and the third confronting leg pairs are received within the third side wall grooves. The side wall grooves are of a predetermined width to receive a mounting strip extending from the top wall and the bottom wall into the respective grooves.

Modifications of the invention include at least, if not all, of the foundation rails 11, 12, and 13 including a spaced series of gel packets 29 mounted to the top and bottom walls at the predetermined spacings. The gel packets 29 are fixedly mounted to the top and bottom walls, wherein a modified mounting strip 23*a* is provided (see FIG. 10) that includes a cutting rib 28 that is positioned medially between each of the leg pairs and extends parallel to the leg pairs coextensively with the leg pairs. When the modified mounting strip is mounted and secured to a respective top or bottom wall of the foundation rail 11, the gel packet 29 is pierced. Each gel packet 29 is defined by a central web 30, wherein an epoxy resin 31 and epoxy hardener 32 are separated initially by the central web, but wherein the central web is pierced to effect mixing of the resin and hardener 31 and 32 to permanently adhere the mounting strips to the foundation rails. The gel packets 29 are spaced apart a predetermined spacing to properly indicate and orient the mounting strips 23 relative to the top and bottom walls of the foundation rails.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in side, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pallet assembly comprising, a plurality of spaced parallel foundation rails to include at least a first foundation rail and a second foundation rail, the first foundation rail including first spaced parallel top and bottom first walls, and the second foundation rail including spaced planar top and bottom second walls, wherein the first and second top walls are coplanar and the first and second bottom walls are coplanar, and the first foundition rail includes spaced parallel first side walls, and the second foundation rail includes spaced parallel second side walls, wherein the first side walls are orthogonally oriented relative to the first top and bottom walls and the second side walls are orthogonally oriented relative to the second top and bottom walls, and a plurality of mounting strips mounted to the first and second foundation rails orthogonally oriented relative to the first and second foundation rails, wherein the mounting strips are spaced apart a predetermined spacing, and including a further plurality of further mounting strips mounted to the first and second foundation rails orthogonally oriented relative to the first and second foundation rails spaced apart a further predetermined spacing mounted to the first and second foundation rails in contiguous communication with the first and second bottom walls, and including first side wall grooves mounted coextensively and parallel relative to one another within the first side walls, and second side wall grooves mounted coextensively and parallel relative to one another within the second side walls, and each of the mounting strips including a plurality of leg pairs including at least a first leg pair and a second leg pair, the first leg pair of each mounting strip mounted within the first grooves, and the second leg pair of each mounting strip mounted within the second groove.

2. An apparatus as set forth in claim 1 wherein said at least first top wall and said first bottom wall includes a plurality of gel packets spaced apart a predetermined spacing and futher predetermined spacing on the top and bottom walls respectively, and each of the gel packets including a central web, the central web defining a top chamber and a bottom chamber, the chamber including an epoxy resin and the bottom chamber including an epoxy hardener, and each of the mounting strips includes a cutting rib mounted fixedly and coextensively to each of the mounting strips between each of thr leg pairs extending medially and coextensively of each of the leg pairs to effect rupturing of the central web upon securement of each mounting strip to the first and second foundation rails.

* * * * *